United States Patent [19]

Burtchell

[11] Patent Number: 4,549,509

[45] Date of Patent: Oct. 29, 1985

[54] TAPPET

[76] Inventor: Darrell A. Burtchell, 141 Route 81, Killingworth, Conn. 06417

[21] Appl. No.: 652,276

[22] Filed: Sep. 20, 1984

[51] Int. Cl.[4] ..... F01L 1/14

[52] U.S. Cl. ..... 123/90.16; 123/90.48; 123/90.50

[58] Field of Search ..... 123/90.48, 90.50, 90.15, 123/90.16

[56] References Cited

U.S. PATENT DOCUMENTS

| | | | |
|---|---|---|---|
| 1,345,942 | 7/1920 | McCain | 123/90.50 |
| 1,345,943 | 7/1920 | McCain | 123/90.50 |
| 1,802,330 | 4/1931 | Boland | 123/90.50 |
| 2,846,988 | 8/1958 | Iskenderian | 123/90.50 |
| 2,977,943 | 4/1961 | Lieberherr | 123/90.15 |
| 2,991,616 | 7/1961 | Miller | 123/90.15 |
| 3,139,076 | 6/1964 | Flaherty | 123/90.50 |
| 4,387,674 | 6/1983 | Connell | 123/90.16 |

FOREIGN PATENT DOCUMENTS

| | | | |
|---|---|---|---|
| 390818 | 3/1924 | Fed. Rep. of Germany | 123/90.50 |

*Primary Examiner*—Ira S. Lazarus

*Attorney, Agent, or Firm*—Kane, Dalsimer, Kane, Sullivan and Kurucz

[57] ABSTRACT

A tappet with an off-center cam following surface offers a means for adjusting the timing of valves, etc., in a cam timing device. For the timing of the valve train in an internal combustion engine, the tappet offers a high degree of flexibility in adjusting the timing.

5 Claims, 3 Drawing Figures

TAPPET

BACKGROUND OF THE INVENTION

1. Field of the Invention

The invention relates to means for adjusting the timing of cam driven apparatus and more particularly relates to a tappet for adjusting such timing.

2. Brief Description of the Prior Art

The timing of many mechanical functions is effected in many instances by the use of cam mechanisms. For example, in the internal combustion engine, the intake and exhaust valves are opened and closed by the valve train. The valve train may comprise a camshaft, cam follower, tappet or pushrod, rocker arm and the valve. The valve train functions to open and close the valve at desired times. The timing of the valve train to open and close the valve or valves can generally be adjusted by a variety of measures such as by shimming the cam. In general, most means of adjusting the timing of the valve train requires skill, special tools and/or complex disassembly and assembly procedures.

The tappet of the present invention is an improvement, enabling one to adjust the timing of a valve train by replacement or adjustment of the tappet alone.

SUMMARY OF THE INVENTION

The invention comprises in a tappet, which comprises; a rod having (i) a first end;

(ii) a second end, including a cam following surface;

(iii) a rod body between and joining the first and second ends; and (iv) a central axis running through the center of the rod body from the first end to the second end, dividing the rod body into a forward half and a rearward half;

the improvement, which comprises;

said cam following surface being positioned off said axis in one of the forward and rearward halves.

The improved tappet of the invention is useful for adjusting the timing of a cam mechanism, to improve performance specifications and, in the case of internal combustion engines, gas mileage.

DETAILED DESCRIPTION OF THE PREFERRED EMBODIMENTS OF THE INVENTION

Those skilled in the art will gain an appreciation of the invention from the following description when read with a viewing of the accompanying drawings.

Figure 1:
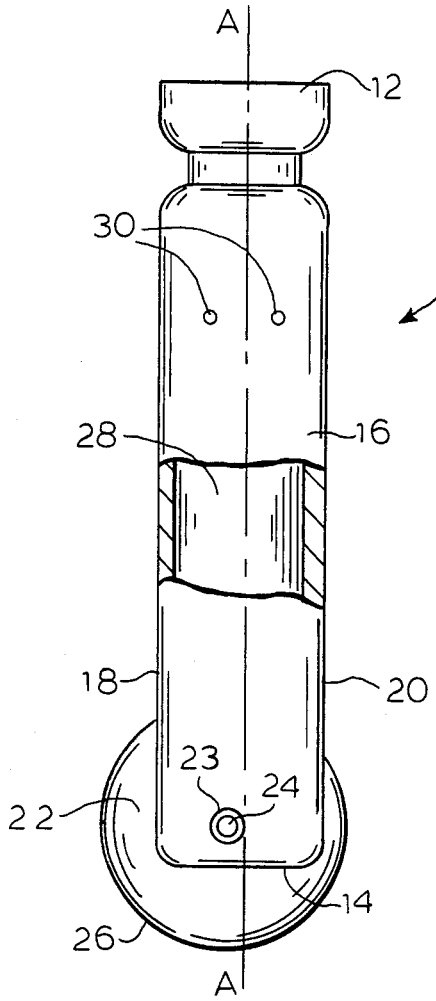
FIG. 1 is a side elevation of a preferred embodiment tappet of the invention.

The drawing of FIG. 1 is a side elevation of a preferred embodiment tappet 10 of the invention. The tappet 10 comprises a rod having a first end 12 for association with a valve train such as an exhaust or intake valve (not shown in the drawing). A second end 14 is joined to the first end 12 by the rod body 16 which is of a size and configuration to slidably fit within a tappet guide (not shown in the drawing).

As depicted by a straight line A—A, a central axis runs through the center of the rod body 16, from the first end 12 to the second end 14. The axis line A—A divides the rod body 16 and ends 12,14 into a forward half 18 and a rearward half 20.

Figure 3:
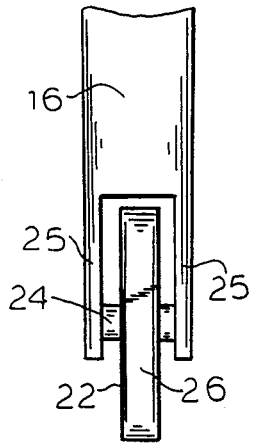
FIG. 3 is a view of the tappet as in FIG. 2 but rotated 90 degrees.

The tappet 10 is of the type referred to as a roller tappet. A roller 22 is on the end 14, mounted thereon between legs 25 (see FIG. 3) through the agency of roller race 23 and axle or pin 24. The roller 22 and race 23 freely rotate about pin 24 in a forward or rearward direction between legs 25 (see FIG. 3). The surface 26 of roller 22 functions as the cam follower, making contact with the cam (not shown in the drawing) of the valve train. As shown in the drawing, the roller 22 is mounted on end 14 at a position forward of the axis line A—A. This is a departure from the prior art, wherein the roller 22 would be mounted on the axis line A—A rather than being offset.

It is well known to those skilled in the art that the revolutions per minute (RPM) one can obtain from an internal combustion engine is limited by the inertia of the valve train components. Accordingly, the preferred embodiment tappet 10 is fabricated from lightweight metal alloys such as an alloy of aluminum, titanium, lightweight steels and the like. In the same vein, the tappet 10 is made lighter by a partial hollowing of the rod body 16 to remove inner aspects and weight (see hollow or partial bore 28). The reduction of weight in the valve train will also raise the limitations upon RPM imposed by inertia. For improved lubrication, the tappet 10 has oil apertures 30 through the wall or rod body 16, communicating with the hollow or bore 28. Oil or other lubricant can gain access to the outer surface of the rod body 16 to lubricate the sliding of the tappet 10 within the tappet guide.

The tappet 10 of the invention may be manufactured with the cam follower surface 26 advanced or retarded in regard to its contact with a cam surface. By positioning of the roller 22 off center in regard to the axis of the rod body 16, the cam follower surface is advanced or retarded. The crankshaft degree of advancement or retardation is dependent upon the distance the roller 22 is off the axis line. It will also be appreciated that the diameter of the roller 22 and of the cam base circle will also be factors in determining the degree of advancement or retardation of the cam follower surface. However, those skilled in the art will appreciate that the crankshaft degree of advancement may be readily calculated mathematically or by trail and error for any specific requirement. As an example, in a tappet of the roller type used in a commercially available motorcycle, such as tappet 10 described above, having a roller 22 diameter of 0.854 inches, offsetting the roller 22 by 0.008 inches will advance or retard the cam following surface by approximately 1°. Thus, if one wishes to advance or retard by, say 3°, one would employ a tappet 10 with roller 22 offset from the center axis A—A by 0.024 inches. The one tappet 10 may be used to either advance or retard the valve action, depending on how the tappet 10 is assembled in the valve train. Thus, if the tappet 10 is assembled with the cam so that the roller 2 is forward of axis line A—A (so that the cam follower surface 26 meets the cam surface earlier than it would if the roller 22 were mounted on the axis line A—A) the timing of the valve train will be advanced. If the tappet 10 is rotated 180° when assembled in the valve train, the timing will be retarded to an equal degree (because the cam follower surface 26 will arrive at a given point on the cam surface at a later time).

The invention also comprises a kit, useful in the method of the invention, i.e., to adjust the timing of a valve train. The method comprises replacing the tappet previously assembled in the valve train with a tappet 10 of the invention to advance or retard the timing of the valve train. The kit of the invention may comprise a plurality of tappets 10 of the invention, each differing from the other in the distance the roller 22 is offset from the central axis line A—A (thus providing different degrees of timing adjustment). With such a kit one can modify a valve train as desired. The kit can also include a conventional means of measuring the degree of cam movement such as a degree wheel and means of attachment to a crankshaft.

Figure 2:
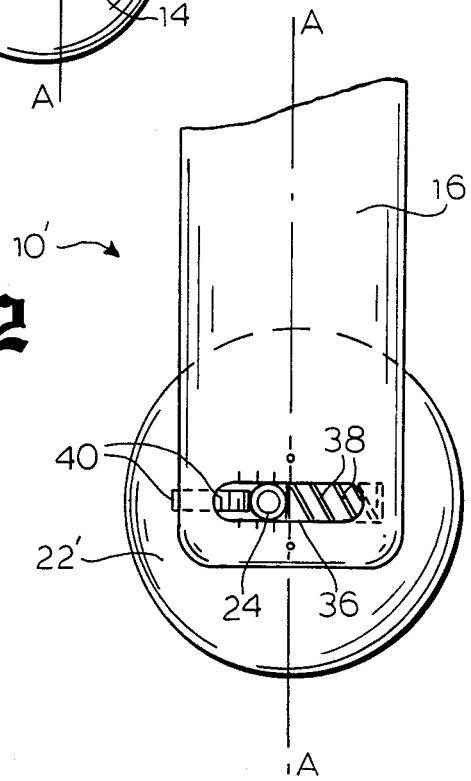
FIG. 2 is a view of a portion of an alternate embodiment tappet of the invention.

FIG. 2 is a view of a portion of an alternate embodiment tappet 10' of the invention, which is adjustable to offset the cam following surface, any desired distance from the axis line A—A. In adjusting the variable offset distances, any desired degree of advancement or retardation of the timing of the valve train may be effected. The tappet 10' of the invention differs from the tappet 10 described above in that the roller 22 is mounted so that pin 24 may be moved forward or backward in slot 36 (thereby offsetting the position of roller 2 and cam following surface 26 in respect to the axis line A—A). Slots 36 pierce each leg 25 to support the roller 22 thereon. Movement of the pin 24 and thereby roller 22 is adjusted through the means of set screw 40 which is set against the pressure of spring 38 to maintain a desired position of roller 22. It will be appreciated that the opposite end of pin 24 will be similarly mounted in the opposite side of tappet 10' (not seen in FIG. 2) in a like slot 36, held in position by a like spring 38 and a like set screw 40. As shown in FIG. 2, degree indicia can be imprinted along the length of slot 36 so that a given degree of timing change can be coordinated with the distance the roller 22 is offset from axis A—A.

Although the invention has been described herein in terms of a preferred embodiment, i.e., a tappet for adjusting the timing in the valve train of an internal combustion engine, it will be appreciated that such should not be construed as limiting the claims. The invention contemplated includes the improvement of any cam operated timing device, including but not limited to cam timing mechanisms associated with sewing machines, water conditioners, watering devices, meters and the like. Similarly, the invention is not limited to improved roller types of tappet, but includes bucket or cup types, flat types and the like, improved by an offset of the cam following surface, as described above, by at least 0.003 inches (preferably at least 0.004 inches, most preferably 0.008 inches).

What is claimed is:

1. In a tappet, which comprises; a rod having (i) a first end;

(ii) a second end, including a cam following surface which is a roller surface;

(iii) a rod body between and joining the first and second ends; and (iv) a central axis running through the center of the rod body from the first end to the second end, dividing the rod body into a forward half and a rearward half;

said tappet being slidably fit within a tappet guide;

the improvement, which comprises; said cam following surface being positioned off said axis in one of the forward and rearward halves.

2. The tappet of claim 1 wherein the rod body is partially hollow.

3. The tappet of claim 2 wherein apertures communicate between the partial hollow and the outer surface of the rod body.

4. The tappet of claim 1 wherein the cam following surface is movable from a first position off said axis to a second position on or off said axis.

5. A method of adjusting the timing of a valve train, said valve train comprising a camshaft, a cam follower, a tappet slidingly fitted in a tappet guide, a rocker arm and a valve, said tappet comprising a rod body having (i) a first end;

(ii) a second end, including a roller cam following surface;

(iii) a rod body between and joining the first and second ends; and (iv) a central axis running through the center of the rod body from the first end to the second end, dividing the rod body into a forward half and a rearward half;

which comprises; replacing the tappet of said valve train with a tappet having the roller cam following surface positioned off said axis in one of the forward and rearward halves.

* * * * *